US010172431B2

(12) United States Patent
Saito et al.

(10) Patent No.: US 10,172,431 B2
(45) Date of Patent: Jan. 8, 2019

(54) PEN AND PEN REFILL

(71) Applicant: Kuretake Co., Ltd., Nara (JP)

(72) Inventors: Natsumi Saito, Nara (JP); Katsuhiro Sasaki, Nara (JP)

(73) Assignee: Kuretake Co., Ltd., Nara (JP)

( * ) Notice: Subject to any disclaimer, the term of this patent is extended or adjusted under 35 U.S.C. 154(b) by 74 days.

(21) Appl. No.: 15/517,346

(22) PCT Filed: Oct. 14, 2015

(86) PCT No.: PCT/JP2015/079094

§ 371 (c)(1),
(2) Date: Apr. 6, 2017

(87) PCT Pub. No.: WO2016/060184

PCT Pub. Date: Apr. 21, 2016

(65) Prior Publication Data

US 2017/0295906 A1 Oct. 19, 2017

(30) Foreign Application Priority Data

Oct. 16, 2014 (JP) ..... 2014-212002

(51) Int. Cl.

| | |
|---|---|
| ***A45D 34/04*** | (2006.01) |
| ***B43K 8/02*** | (2006.01) |
| ***B43K 5/10*** | (2006.01) |
| ***B43K 8/08*** | (2006.01) |
| ***B43K 3/00*** | (2006.01) |

(52) U.S. Cl.

CPC ..... *A45D 34/04* (2013.01); *B43K 3/00* (2013.01); *B43K 8/02* (2013.01); *B43K 8/08* (2013.01); *B43K 5/10* (2013.01)

(58) Field of Classification Search

CPC ..... A45D 34/04; A45D 34/00; B43K 8/02; B43K 8/08; B43K 3/00; B43K 5/10; B43K 5/18; B43K 1/00; B43K 1/003; B43K 1/01; B43K 5/00

See application file for complete search history.

(56) References Cited

U.S. PATENT DOCUMENTS

| | | | |
|---|---|---|---|
| 4,408,921 | A | 10/1983 | Nagai |
| 4,568,214 | A | 2/1986 | Abe et al. |
| 4,685,820 | A | 8/1987 | Kremer et al. |

(Continued)

FOREIGN PATENT DOCUMENTS

| | | | |
|---|---|---|---|
| CN | 1246081 | A | 3/2000 |
| CN | 1328507 | A | 12/2001 |

(Continued)

*Primary Examiner* — David Walczak

(74) *Attorney, Agent, or Firm* — The Webb Law Firm

(57) ABSTRACT

A pen including an ink reservoir to store an ink; a pen tip which has a proximal end and a distal end opposite to the proximal end and applies an ink to a coating target; an ink guide to guide the ink in the reservoir toward the pen tip; and a holder part which has a through hole through which the pen tip is inserted and holds at least the proximal end of the pen tip while exposing the distal end of the pen tip with the pen tip inserted through the through hole. The holder part includes: an ink holding part capable of holding the ink from the ink guide and formed at least partially around a circumference of the through hole; and a first opening opening on an inner circumferential surface that defines the through hole and communicating with the ink holding part.

16 Claims, 15 Drawing Sheets

(56) References Cited

U.S. PATENT DOCUMENTS

| | | | |
|---|---|---|---|
| 6,089,776 | A | 7/2000 | Kaufmann |
| 6,095,707 | A | 8/2000 | Kaufmann |
| 6,210,063 | B1 | 4/2001 | Isobe et al. |
| 6,276,860 | B1 | 8/2001 | Nakajima et al. |
| 6,322,268 | B1 | 11/2001 | Kaufmann et al. |
| 6,416,242 | B1 | 7/2002 | Kaufmann |
| 6,474,895 | B2 | 11/2002 | Hori |
| 2002/0018690 | A1 | 2/2002 | Hori |
| 2002/0057940 | A1 | 5/2002 | Kaufmann |
| 2006/0210348 | A1 | 9/2006 | Wang |

FOREIGN PATENT DOCUMENTS

| | | | |
|---|---|---|---|
| GB | 2136279 | A | 9/1984 |
| GB | 2170998 | A | 8/1986 |
| JP | 5786378 | U | 5/1982 |
| JP | 5786389 | U | 5/1982 |
| JP | 59141907 | U | 9/1984 |
| JP | 607191 | Y2 | 3/1985 |
| JP | 6136387 | Y2 | 10/1986 |
| JP | 6510491 | A | 11/1994 |
| JP | 834193 | A | 2/1996 |
| JP | 200163278 | A | 3/2001 |
| JP | 2002264973 | A | 9/2002 |
| JP | 2005342950 | A | 12/2005 |
| JP | 2012111192 | A | 6/2012 |
| JP | 2012135982 | A | 7/2012 |

PEN AND PEN REFILL

CROSS-REFERENCE TO RELATED APPLICATIONS

This application is the United States national phase of International Application No. PCT/JP2015/079094 filed Oct. 14, 2015, and claims priority to Japanese Patent Application No. 2014-212002 filed Oct. 16, 2014, the disclosures of which are hereby incorporated in their entirety by reference.

FIELD

The present invention relates to a pen and a pen refill used as a writing tool or a makeup kit.

BACKGROUND

Conventionally, there have been various types of writing tools and makeup kits, and as an example thereof, a pen configured to be capable of applying an ink to an object or the like is known.

The pen of this type includes an ink reservoir configured to store the ink, a pen tip configured to apply the ink to an ink coating target, and an ink guide configured to guide the ink in the ink reservoir toward the pen tip.

The ink reservoir has a circumferential wall that defines an internal space containing the ink. There are various ink reservoirs, and examples thereof include an ink reservoir with an internal space filled with a liquid ink (see Patent Literature 1, for example), an ink reservoir with an internal space entirely filled with an ink absorbing member which has liquid absorbability and has absorbed an ink (see Patent Literature 2, for example), and an ink reservoir with a specific region of an internal space filled with a liquid ink and with the remaining region of the internal space filled with an ink absorbing member which has liquid absorbability and has absorbed an ink (see Patent Literature 3, for example).

Examples of the pen tip include a pen tip formed by bundling a large number of hair strands and a pen tip formed by molding a fiber material into a rod shape. The pen tip has a proximal end connected to an ink guide and a distal end located opposite to the proximal end and is configured to contact a coating target. The pen tip is configured to allow the ink from the ink guide to adhere thereon from the proximal end to the distal end by capillary force or surface tension.

The ink guide is generally called induction core or relay core and is molded into a rod shape. The ink guide has one end connected to the ink reservoir and the other end provided opposite to the one end and connected to the pen tip, and has a communication part configured to communicate the one end with the other end on at least one of the outer surface and inside thereof. Examples of the communication part include open cells, interconnected micropores, and microgrooves, and the ink guide guides the ink in the ink reservoir to the pen tip by capillary force of the communication part.

The pen of this type is configured so that, when the distal end of the pen tip contacts an ink coating target, the ink on the pen tip is transferred to the coating target, and the ink on the pen tip is consumed. Then, the ink in the ink guide is supplied to the pen tip by capillary force or surface tension of the pen tip. Accordingly, the ink in the ink reservoir is supplied to the ink guide by capillary force or surface tension of the ink guide.

Thus, the pen of this type is configured to be capable of continuously applying the ink to the ink coating target.

CITATION LIST

Patent Literature

Patent Literature 1: Japanese Examined Utility Model Application Publication No. S60-7191 Y Patent Literature 2: JP 2005-342950 A Patent Literature 3: JP 2012-135982 A

SUMMARY

Technical Problem

By the way, there may be cases where the pen tip of this type gets dry when an unused state continues, and use of the pen cannot be smoothly started.

Specifically, the pen of this type can maintain the pen tip in a moist state, because the ink in the ink reservoir is supplied to the pen tip when the ink adhering to the pen tip is consumed.

However, when an unused state continues in the pen of this type, the ink is not newly supplied to the pen tip, and therefore the ink that has already adhered to the pen tip tends to evaporate or volatilize as it is. Accordingly, when the pen tip gets dry, the components of the ink or foreign matter may be solidified at the pen tip in some cases.

Therefore, the pen of this type has suffered from problems such as being no longer usable or being unusable until the ink in the ink reservoir is supplied to the pen tip (until the pen tip is abundantly supplied with the ink).

It is therefore an object of the present invention to provide a pen and a pen refill, the use of which can be started smoothly by suppressing the dryness of the pen tip.

Solution to Problem

The pen according to the present invention includes: an ink reservoir configured to store an ink; a pen tip having a proximal end and a distal end opposite to the proximal end, the pen tip being configured to apply an ink to an ink coating target; an ink guide configured to guide the ink in the ink reservoir toward the pen tip; and a holder part having a through hole through which the pen tip is inserted, the holder part being configured to hold at least the proximal end of the pen tip while exposing the distal end of the pen tip in the state where the pen tip is inserted through the through hole, wherein the holder part includes: an ink holding part capable of holding the ink from the ink guide and formed at least partially around a circumference of the through hole; and a first opening opening on an inner circumferential surface that defines the through hole and communicating with the ink holding part.

As an aspect of the pen according to the present invention, it is preferable that the ink holding part be formed into a slit shape.

As another aspect of the pen according to the present invention, it is preferable that the first opening be formed into a slit shape.

As still another aspect of the pen according to the present invention, it is preferable that a plurality of ink holding parts as described above be formed around the circumference of the through hole, and a plurality of first openings as described above be formed around the circumference of the through hole, corresponding to the plurality of ink holding parts.

As still another aspect of the pen according to the present invention, it is preferable that the holder part further include: a distal end face from which the distal end of the pen tip extends; an annular surface formed around the circumference of the through hole and facing opposite to the distal end face; and a second opening opening on the annular surface and communicating with the ink holding part.

In this case, it is preferable that the second opening be formed into a slit shape.

Further, the configuration may be such that the ink guide is formed into a rod shape having one end connected to the ink reservoir and the other end opposite to the one end, and the other end is formed to overlap the second opening.

In this case, the configuration may be such that the other end of the ink guide has at least two or more divided portions divided with respect to its axial center, and the two or more divided portions are formed to extend in a direction intersecting its axial center and overlap the second opening.

A pen refill according to the present invention includes: an ink reservoir configured to store an ink and housed in a barrel shaft constituting the exterior of a pen; a pen tip having a proximal end and a distal end opposite to the proximal end, the pen tip being configured to apply an ink to an ink coating target by being exposed from the barrel shaft; an ink guide configured to guide the ink in the ink reservoir toward the pen tip; and a holder part having a through hole through which the pen tip is inserted, the holder part being configured to hold at least the proximal end of the pen tip while exposing the distal end of the pen tip in the state where the pen tip is inserted through the through hole, wherein the holder part includes: an ink holding part capable of holding the ink from the ink guide and formed at least partially around a circumference of the through hole; and a first opening opening on an inner circumferential surface that defines the through hole and communicating with the ink holding part.

As an aspect of the pen refill according to the present invention, it is preferable that the ink holding part be formed into a slit shape.

As another aspect of the pen refill according to the present invention, it is preferable that the first opening be formed into a slit shape.

As still another aspect of the pen refill according to the present invention, it is preferable that a plurality of ink holding parts as described above be formed around the circumference of the through hole, and a plurality of first openings as described above be formed around the circumference of the through hole, corresponding to the plurality of ink holding parts.

As still another aspect of the pen refill according to the present invention, it is preferable that the holder part further include: a distal end face from which the distal end of the pen tip extends; an annular surface formed around the circumference of the through hole and facing opposite to the distal end face; and a second opening opening on the annular surface and communicating with the ink holding part.

In this case, it is preferable that the second opening be formed into a slit shape.

Further, the configuration may be such that the ink guide is formed into a rod shape having one end connected to the ink reservoir and the other end opposite to the one end, and the other end is formed to overlap the second opening.

In this case, the configuration may be such that the other end of the ink guide has at least two or more divided portions divided with respect to its axial center, and the two or more divided portions are formed to extend in a direction intersecting its axial center and overlap the second opening.

DESCRIPTION OF EMBODIMENTS

Hereinafter, an embodiment of the present invention will be described with reference to the attached drawings. While the pen according to the present invention is used as a writing tool or a makeup kit, a makeup kit (eyeliner pen) will be described as an example in this embodiment.

Figure 1:
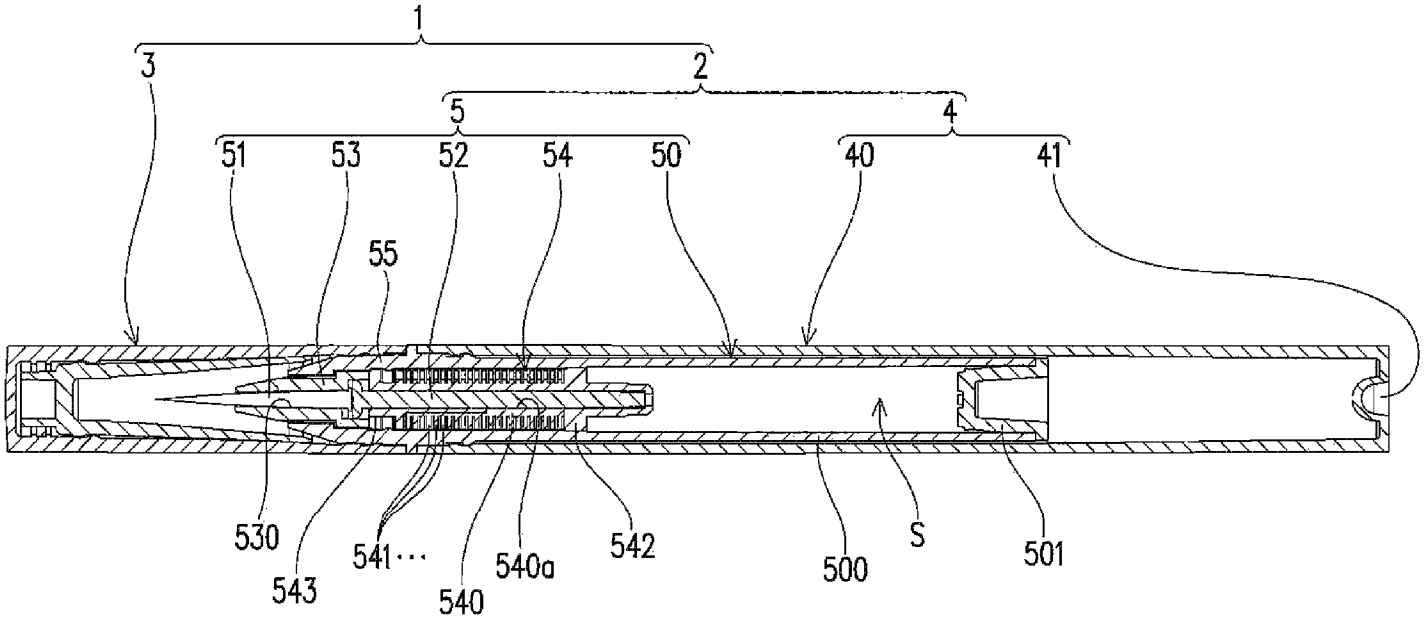
FIG. 1 is a sectional view of a pen according to an embodiment of the present invention.
Figure 2:
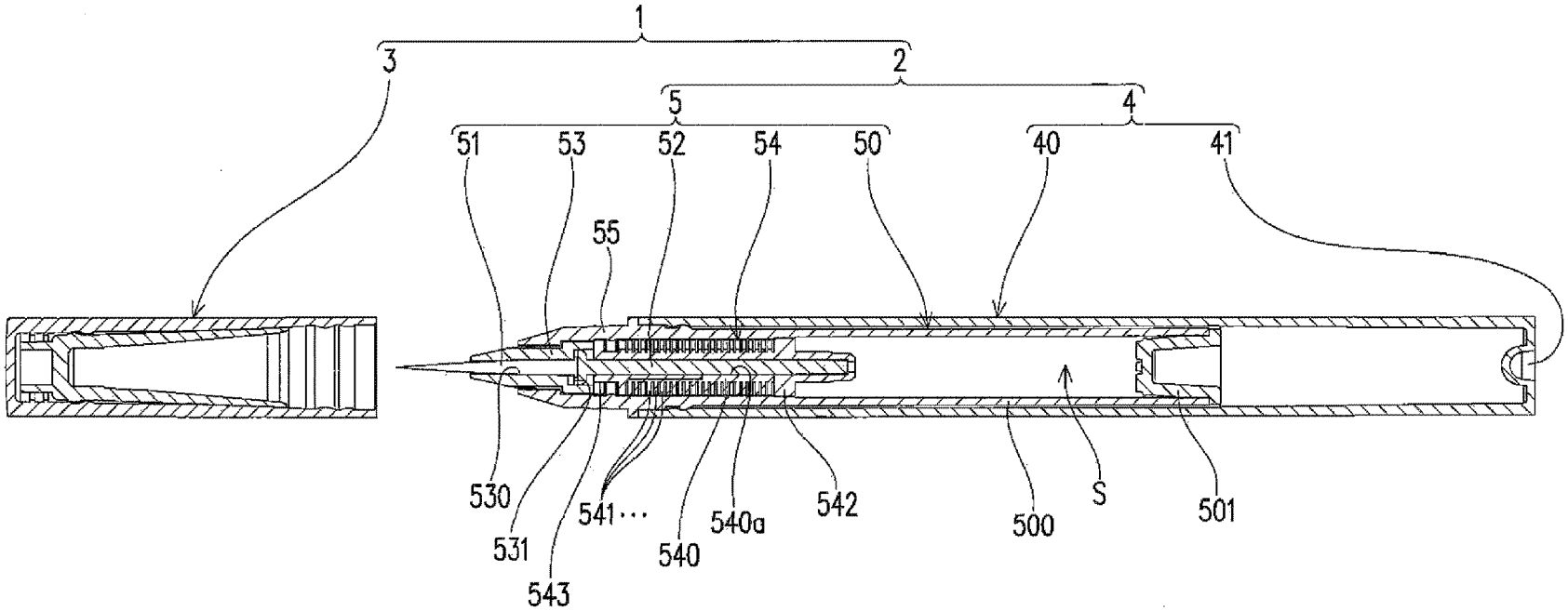
FIG. 2 is a sectional view of the pen according to the aforementioned embodiment when a cap is detached from a pen body.

As shown in FIG. 1 and FIG. 2, a pen according to this embodiment includes a pen body 2 having a pen tip 51 configured to apply an ink (eyeliner ink in this embodiment) to an ink coating target (makeup target in this embodiment), and a cap 3 configured to cover the pen tip 51 of the pen body 2.

The pen body 2 includes an exterior body 4 constituting the exterior, and a pen refill (hereinafter, simply referred to as refill) 5 provided inside the exterior body 4.

The exterior body 4 includes a cylindrical barrel shaft 40 having one end and the other end opposite to the one end, and a tail 41 closing the one end of the barrel shaft 40.

The refill 5 includes an ink reservoir 50 configured to store an ink, the pen tip 51 having a proximal end and a distal end opposite to the proximal end, the pen tip 51 being configured to apply the ink to an ink coating target, an ink guide 52 configured to guide the ink in the ink reservoir 50 toward the pen tip 51, and a holder part 53 having a through hole 530 through which the pen tip 51 is inserted and being configured to hold at least the proximal end of the pen tip 51 while exposing the distal end of the pen tip 51 in the state where the pen tip 51 is inserted through the through hole 530.

The ink reservoir 50 has a circumferential wall 500 that defines an internal space S containing the ink. More specifically, the ink reservoir 50 of this embodiment includes the cylindrical circumferential wall 500 having one end and the other end opposite to the one end, and a closure part 501 that closes the one end of the circumferential wall 500. Thus, the ink reservoir 50 has the internal space S closed by the circumferential wall 500 and the closure part 501.

Figure 3:
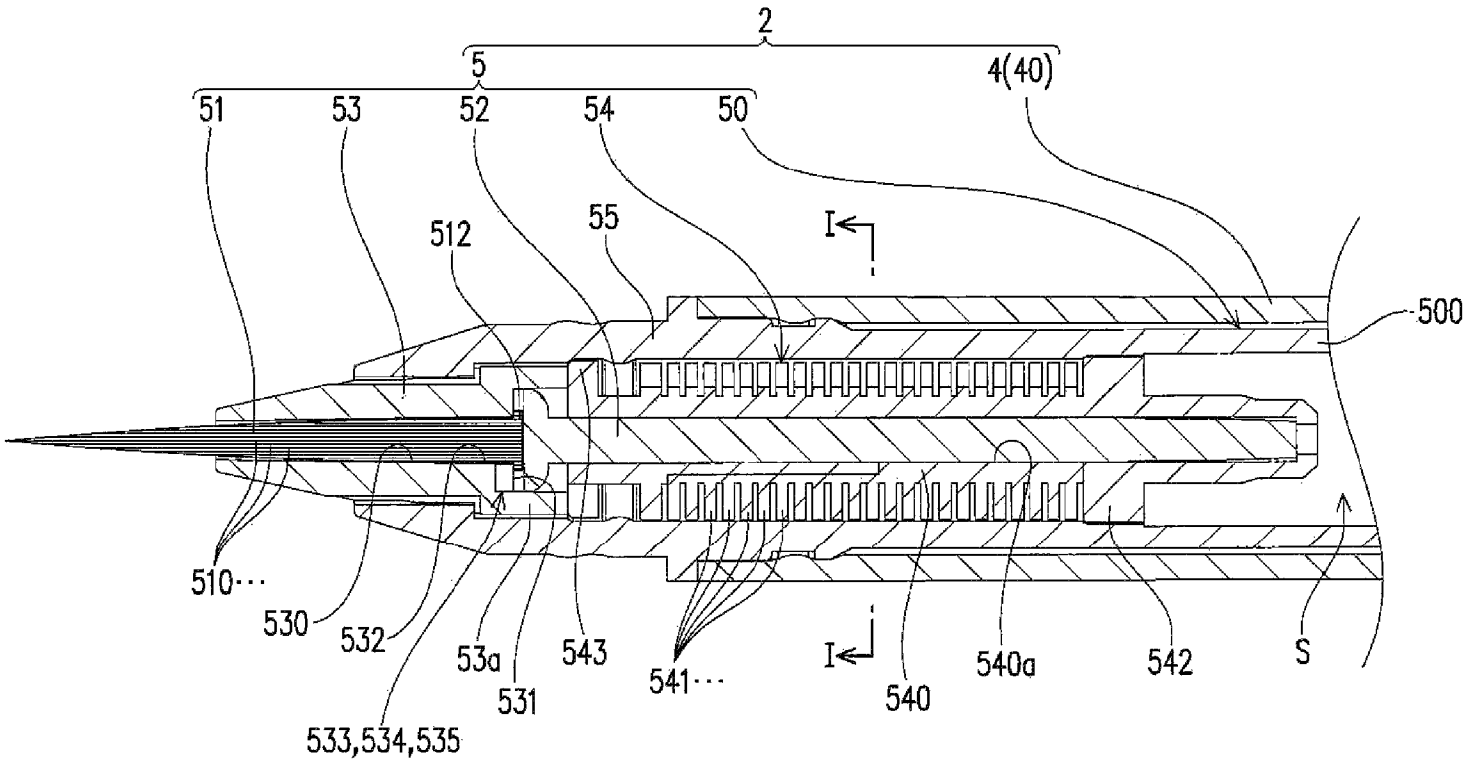
FIG. 3 is a partial enlarged sectional view of the pen (pen body) according to the aforementioned embodiment.

In this embodiment, the internal space S of the ink reservoir 50 is filled with a liquid ink. Along with this, the refill 5 of this embodiment includes a collector 54 configured to adjust the amount of the ink to be supplied to the pen tip 51, as shown in FIG. 1 to FIG. 3.

The collector 54 is a so-called blade adjuster employed for writing tools of the direct liquid type such as a fountain pen. Specifically, the collector 54 includes a main shaft 540 having, along its center line, a through hole 540*a* through which the ink guide 52 is provided, and a plurality of partition blades 541 arranged at intervals in the axis direction of the main shaft 540 and extending from the outer surface of the main shaft 540. The collector 54 has flanges 542 and 543 extending radially outward at both ends of the main shaft 540, and the plurality of partition blades 541 are provided extending from the outer surface of the main shaft 540 between the two flanges 542 and 543.

Each of the plurality of partition blades 541 extends from substantially the entire perimeter of the main shaft 540 and is formed into a circular plate. Each interval between adjacent partition blades 541 is set so that the capillary force acts between the adjacent partition blades 541.

Figure 4:
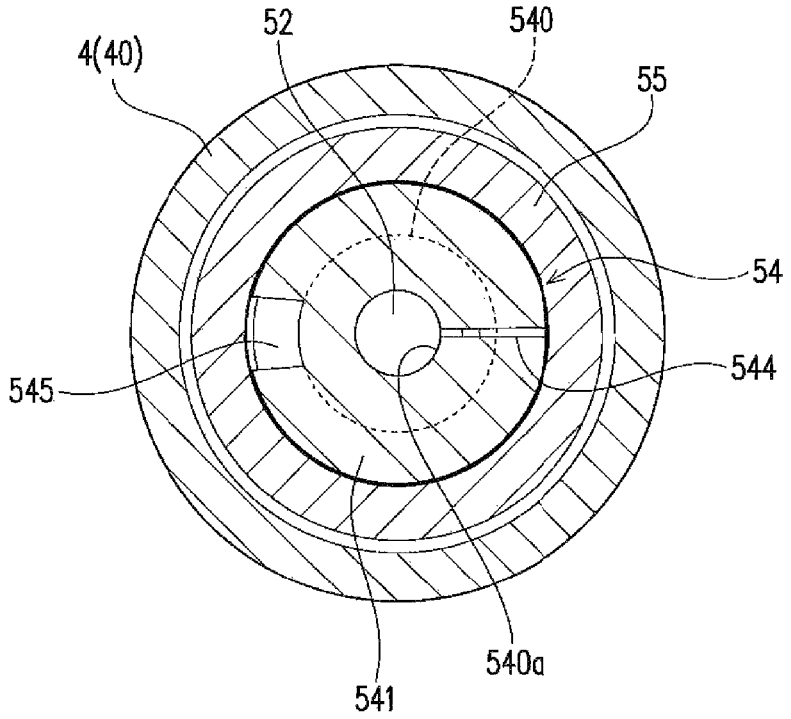
FIG. 4 is a sectional view taken along the line I-I of FIG. 3.

As shown in FIG. 4, a slit 544 extending in the extending direction of the partition blades 541 from the main shaft 540 is formed in each of the plurality of partition blades 541. The slits 544 of the partition blades 541 are formed to make a line in the axis direction of the main shaft 540. The slits 544 of the partition blades 541 open on the inner circumferential surface of the main shaft 540 that defines the through hole 540*a*. Further, in each of the plurality of partition blades 541, a cutout 545 for ventilation is provided at a position displaced from the slit 544 in the circumferential direction of the partition blades 541. The opening area of the cutout 545 as viewed in the axis direction of the main shaft 540 is set larger than that of the slit 544. The collector 54 configured as above is provided so that the flange 542 on one side closes the ink reservoir 50 (internal space 5), as shown in FIG. 3.

More specifically, the refill 5 according to this embodiment includes a cylindrical holding part 55 which is formed continuously with the other end of the circumferential wall 500 that defines the internal space S of the ink reservoir 50 and which is configured to hold the collector 54 and the holder part 53 in the same line. Along with this, the collector 54 is fitted into the cylindrical holding part 55 with the flange 542 on one side located on the ink reservoir 50 side. Thereby, the flange 542 on one side of the collector 54 seals the internal space S of the ink reservoir 50 filled with the ink. Further, the cylindrical holding part 55 surrounds the plurality of partition blades 541 of the collector 54.

The pen tip 51 is composed of a felt tip or a hair bundle capable of holding the ink by capillary force or surface tension, or a material having an outer surface to which the ink can adhere by surface tension or the like. In this embodiment, the pen tip 51 is composed of a hair bundle formed by bundling a plurality of fine hair strands 510. The plurality of fine hair strands 510 are resin fibers, and their ends on one side are integrally fusion welded to form the hair bundle. Accordingly, the pen tip 51 has a welded portion 512 which is formed by fusion welding of the ends on one side of the plurality of fine hair strands 510 and has a diameter larger than the outer diameter (distal end) of the hair bundle.

The ink guide 52 according to this embodiment is a so-called relay core, and is formed into a rod shape having one end connected to the ink reservoir 50 and the other end opposite to the one end. Specifically, the ink guide 52 has liquid absorbability and is molded into a rod shape having a length extending over the ink reservoir 50 (the internal space 5) and the pen tip 51. In general, the ink guide 52 is formed by molding a material having excellent liquid absorbability (such as a foamable resin and a fiber material) into a rod shape, and an ink flow path (not shown) for circulating the ink is formed on the outer surface or inside thereof continuously from the one end to the other end. The ink flow path is composed of a microgroove or continuous micropores (cells).

The ink guide 52 has one end side with at least one end surface exposed to the internal space S of the ink reservoir 50 and the other end side arranged so as to be capable of supplying the ink to the proximal end of the pen tip 51, while it is inserted into the through hole 540*a* of the collector 54 (the main shaft 540).

The ink guide 52 is formed so that the terminal edge of the other end serves as a position to supply the ink. The ink guide 52 according to this embodiment is configured to be capable of supplying the ink to the outer circumference at the proximal end of the pen tip 51. That is, the other end of the ink guide 52 is formed to have a diameter larger than the outer diameter at the proximal end of the pen tip 51 and guides the ink from the outer circumference at the terminal edge to the outer circumference (actually, to the outer side of the outer circumference) at the proximal end of the pen tip 51. In this embodiment, the other end of the ink guide 52 is formed to overlap second openings 535 of the holder part 53, which will be described below.

As described above, the holder part 53 has the through hole 530 through which the pen tip 51 is inserted, and the pen tip 51 is inserted through the through hole 530 with the distal end side extending to the outside.

The holder part 53 is formed into a cylindrical shape. The holder part 53 has a distal end face (not numbered) from which the distal end of the pen tip 51 extends and an annular surface 531 which is formed around the circumference of the through hole 530 and faces opposite to the distal end face of the holder part 53.

Figure 5:
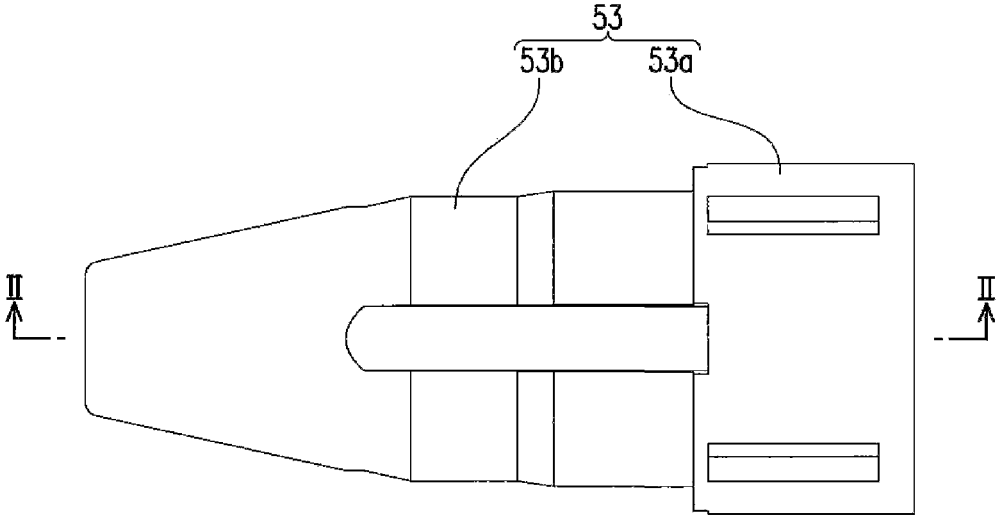
FIG. 5 is a plan view of a holder part in the pen according to the aforementioned embodiment.
Figure 6:
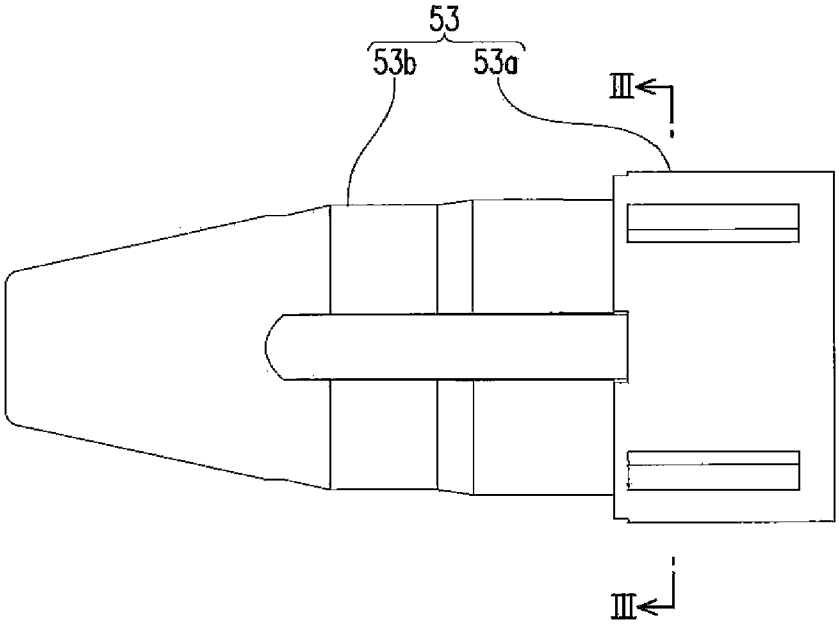
FIG. 6 is a front view of the holder part in the pen according to the aforementioned embodiment.
Figure 7:
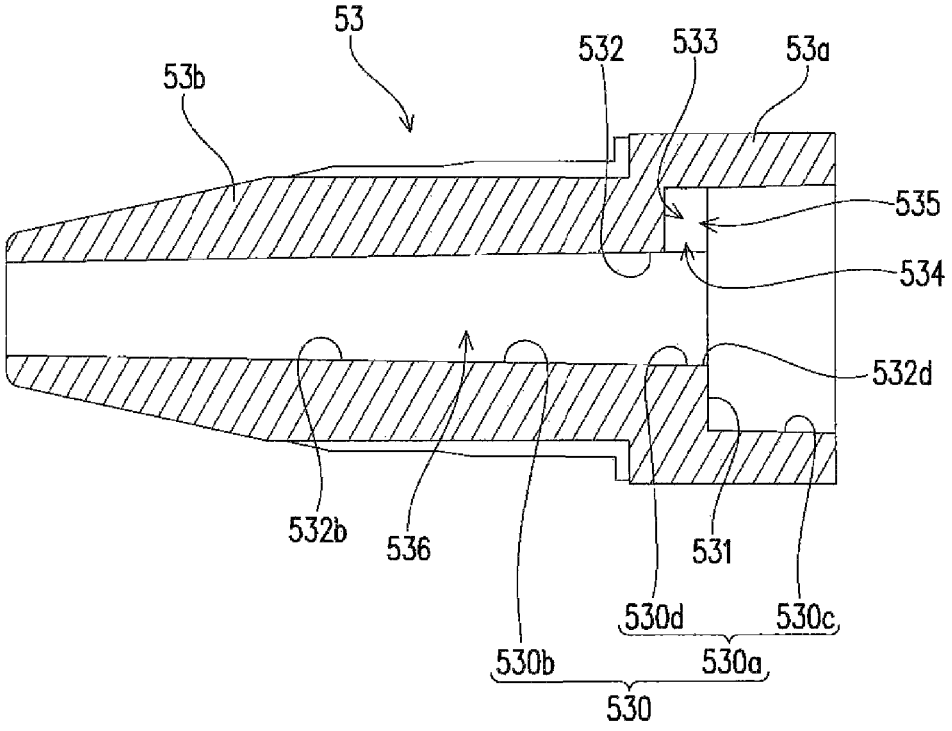
FIG. 7 is a sectional view taken along the line II-II of FIG. 5.

More specifically, as shown in FIG. 5 and FIG. 6, the holder part 53 includes a large diameter cylindrical part 53*a* located on the ink reservoir 50 side and a small diameter cylindrical part 53*b* which is formed to have a diameter smaller than the large diameter cylindrical part 53*a* and is continuous with the large diameter cylindrical part 53*a*. As shown in FIG. 7, an inner hole 530*a* of the large diameter cylindrical part 53*a* and an inner hole 530*b* of the small diameter cylindrical part 53*b* are continuous with each other in a concentric manner.

The inner hole 530*a* of the large diameter cylindrical part 53*a* is composed of a large diameter hole 530*c* set so that the other end of the ink guide 52 can be inserted therein, and a small diameter hole 530*d* which is continuous with the large diameter hole 530*c*, into which the pen tip 51 can be inserted, and which has a diameter smaller than the large diameter hole 530*c*. Thus, a step is formed in the holder part 53 (the large diameter cylindrical part 53*a*) due to the difference in diameter between the large diameter hole 530*c* and the small diameter hole 530*d*. Thus, the holder part 53 has, at the boundary between the large diameter hole 530*c* and the small diameter hole 530*d*, the annular surface 531 which is formed around the circumference of the through hole 530, is continuous with an inner circumferential surface 532 defining the through hole 530, and faces opposite to the distal end of the holder part 53.

The inner hole 530*b* of the small diameter cylindrical part 53*b* is formed concentrically with the inner hole 530*a* of the large diameter cylindrical part 53*a*. Further, the inner hole 530*b* of the small diameter cylindrical part 53*b* is set to have the same diameter as the small diameter hole 530*d* of the large diameter cylindrical part 53*a*, so that the pen tip 51 can be inserted therein.

Accordingly, the inner hole 530*a* of the large diameter cylindrical part 53*a* and the inner hole 530*b* of the small diameter cylindrical part 53*b* are continuous with each other, thereby forming the through hole 530 into which the pen tip 51 is inserted.

An inner circumferential surface 532*d* that defines the small diameter hole 530*d* of the large diameter cylindrical part 53*a* and an inner circumferential surface 532*b* of the inner hole 530*b* of the small diameter cylindrical part 53*b* form a continuous surface. That is, the small diameter hole 530*d* of the large diameter cylindrical part 53*a* and the inner hole 530*b* of the small diameter cylindrical part 53*b* constitute a continuous hole 536 through which the hair bundle of the pen tip 51 can be inserted and which is defined by the inner circumferential surface 532 capable of binding the hair bundle of the pen tip 51. In the following description, a portion of the through hole 530 formed by the small diameter hole 530*d* of the large diameter cylindrical part 53*a* and the inner hole 530*b* of the small diameter cylindrical part 53*b* will be referred to as the continuous hole 536 according to the aforementioned expression.

Figure 8:
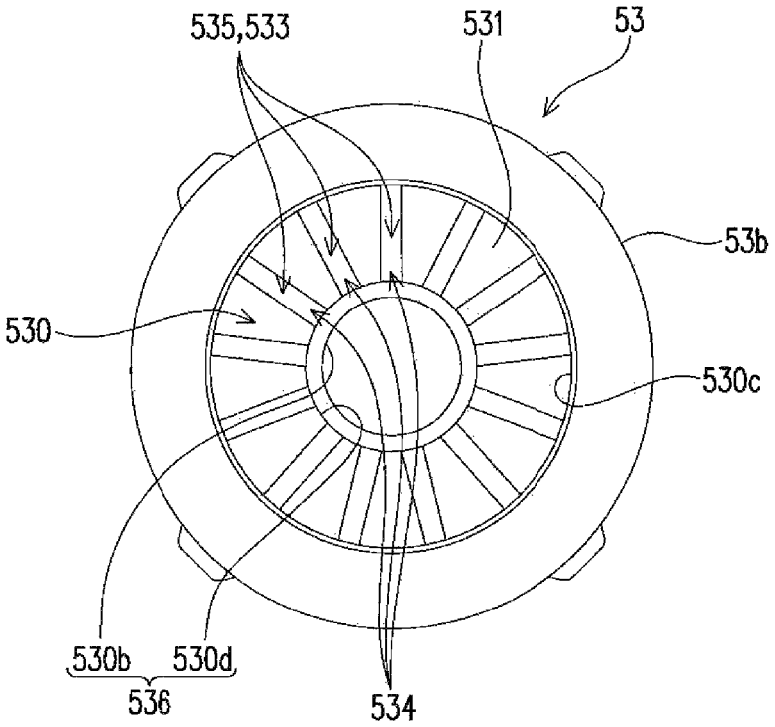
FIG. 8 is a side view of the holder part in the pen according to the aforementioned embodiment, as viewed from one side in the direction in which the center line of the holder part extends.
Figure 9:
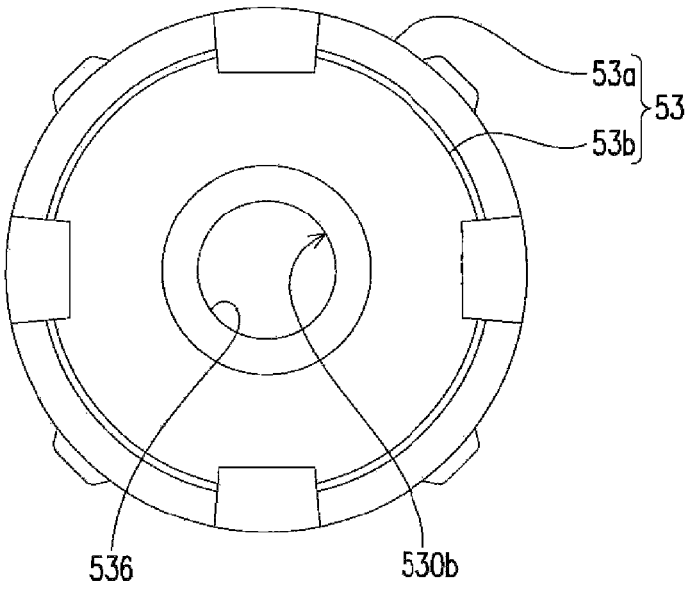
FIG. 9 is a side view of the holder part in the pen according to the aforementioned embodiment, as viewed from the other side in the direction in which the center line of the holder part extends.

The continuous hole 536 is formed according to the shape of the pen tip 51 to be held. In this embodiment, as shown in FIG. 8 and FIG. 9, the continuous hole 536 is formed into a circular shape as viewed in the extending direction of the center line of the continuous hole 536. In this embodiment, since the pen tip 51 is composed of the hair bundle, the continuous hole 536 is formed as a tapered hole having a diameter decreasing from the large diameter cylindrical part 53*a* side toward the distal end face side of the holder part 53, as shown in FIG. 7.

The holder part 53 according to this embodiment includes ink holding parts 533 capable of holding the ink from the ink guide 52 and formed at least partially around the circumference of the through hole 530, and first openings 534 opening on the inner circumferential surface 532 that defines the through hole 530 and communicating with the ink holding parts 533. A plurality of ink holding parts 533 are formed around the circumference of the through hole 530, and a plurality of first openings 534 are formed around the circumference of the through hole 530, corresponding to the plurality of ink holding parts 533. In this embodiment, the ink holding parts 533 and the first openings 534 are each formed into a slit shape (narrow gap shape).

In addition to the aforementioned configuration, the holder part 53 further includes the second openings 535 opening on the annular surface 531 and communicating with the ink holding parts 533. In this embodiment, the second openings 535 are formed into a slit shape (narrow gap shape).

Figure 10:
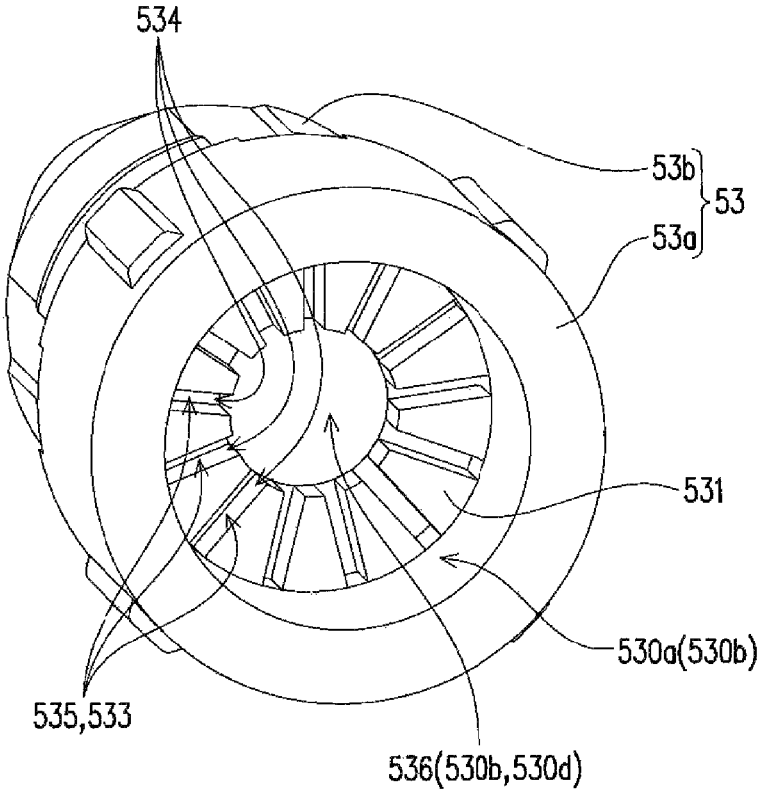
FIG. 10 is a perspective view of the holder part in the pen according to the aforementioned embodiment.
Figure 11:
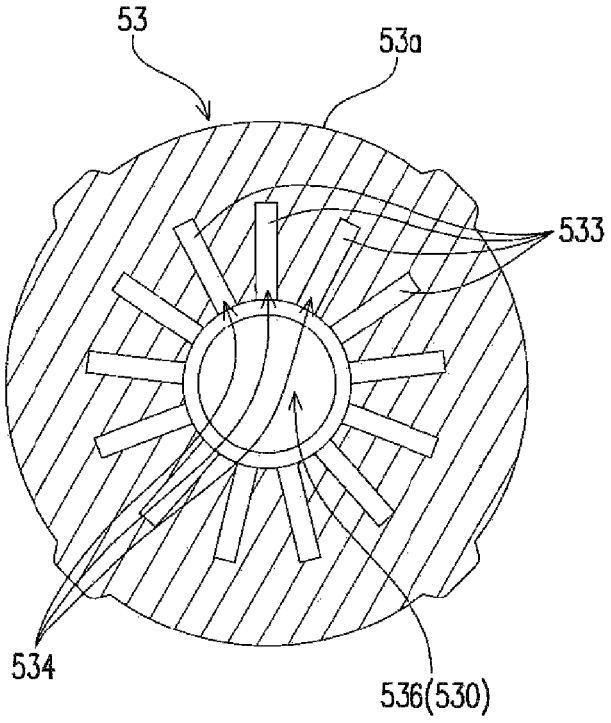
FIG. 11 is a sectional view taken along the line III-III of FIG. 6.

As shown in FIG. 8, FIG. 10, and FIG. 11, the ink holding parts 533 are provided around the circumference of the continuous hole 536 in the through hole 530. The ink holding parts 533 are formed into a slit shape extending in the same direction as the center line of the through hole 530 (the continuous hole 536). Here, the slit shape means to be formed like a narrow gap capable of exerting capillary force. In this embodiment, a plurality of ink holding parts 533 are provided around the circumference of the through hole 530 (the continuous hole 536). The ink holding parts 533 are formed into a slit shape extending in the same direction as the center line of the through hole 530 (the continuous hole 536) as described above, so that the plurality of ink holding parts 533 are radially arranged with the through hole 530 (the continuous hole 536) at the center.

As shown in FIG. 7, the ink holding parts 533 are formed within a specific range on the proximal end side of the holder part 53 in the direction of the center line of the through hole 530. Accordingly, the ink holding parts 533 are formed so as not to allow the circulation of the ink toward the distal end face side of the holder part 53 from which the pen tip 51 is exposed. That is, the ink holding parts 533 are formed so as to be capable of inhibiting the outflow of the ink toward the distal end side so that, when the ink adhering to the pen tip 51 is applied to the coating target, the inflowing ink is not supplied to the distal end of the pen tip 51 by being drawn to the distal end side of the pen tip 51.

As shown in FIG. 8, FIG. 10, and FIG. 11, the first openings 534 are provided around the circumference of the continuous hole 536 in the through hole 530 and open on the inner circumferential surface 532 that defines the through hole 530 (the continuous hole 536). The first openings 534 are formed into a slit shape extending in the same direction as the center line of the through hole 530 (the continuous hole 536). Here, the slit shape means to be formed like a narrow gap capable of exerting capillary force. In this embodiment, a plurality of first openings 534 are provided around the circumference of the through hole 530 (the continuous hole 536). In this embodiment, the plurality of first openings 534 are arranged corresponding respectively to the plurality of ink holding parts 533. That is, each of the plurality of first openings 534 is formed as a single slit together with its corresponding ink holding part 533. Accordingly, the plurality of first openings 534 are radially arranged with the through hole 530 (the continuous hole 536) at the center.

The first openings 534 are formed within a specific range on the proximal end side of the holder part 53 in the direction of the center line of the through hole 530. Accordingly, like the ink holding parts 533, the first openings 534 are formed so as not to allow the circulation of the ink toward the distal end face side of the holder part 53 from which the pen tip 51 is exposed. That is, the first openings 534 are formed so as to be capable of inhibiting the outflow of the ink toward the distal end face side of the holder part 53 so that, when the ink adhering to the pen tip 51 is applied to the coating target, the inflowing ink is not supplied to the distal end of the pen tip 51 by being drawn to the distal end side of the pen tip 51.

As shown in FIG. 8 and FIG. 10, the second openings 535 are provided around the circumference of the continuous hole 536 in the through hole 530 and open on the annular surface 531 formed at the boundary between the large diameter hole 530*c* and the small diameter hole 530*d*. The second openings 535 are formed into a slit shape extending in the radial direction of the through hole 530 (the continuous hole 536). Here, the slit shape means to be formed like a narrow gap capable of exerting capillary force. In this embodiment, the plurality of second openings 535 are provided around the circumference of the through hole 530 (the continuous hole 536). In this embodiment, the plurality of second openings 535 are arranged corresponding respectively to the plurality of ink holding parts 533. That is, each of the plurality of second openings 535 forms a single slit together with its corresponding ink holding part 533 and first opening 534. Accordingly, the plurality of second openings 535 are radially arranged with the through hole 530 (the continuous hole 536) at the center.

In this way, in the holder part 53 of this embodiment, the ink holding parts 533, the first openings 534, and the second openings 535 are arranged and formed corresponding to one another, so that the ink holding parts 533, the first openings 534, and the second openings 535 each form a single slit (gap) opening at two points on the inner circumferential surface 532 of the through hole 530 (the continuous hole 536) and the annular surface 531. In this embodiment, the first opening 534 and the second opening 535 open in different directions but continuously open at the connection point between the inner circumferential surface 532 of the through hole 530 (the continuous hole 536) and the annular surface 531.

Further, along with the aforementioned configuration of the holder part 53, the pen tip 51 is inserted through the through hole 530 (the continuous hole 536) with the proximal end of the pen tip 51 (the welded portion 512 where the plurality of fine hair strands 510 are fusion welded) located in the large diameter hole 530*c* (in the state where the welded portion 512 having a large diameter abuts the annular surface 531), and the other end of the ink guide 52 is in tight contact with the proximal end of the pen tip 51 inside the large diameter hole 530*c*, as shown in FIG. 3.

The holder part 53 is fitted into the cylindrical holding part 55 with the large diameter cylindrical part 53*a* located on the ink reservoir 50 side. In such a state, the large diameter cylindrical part 53*a* is in tight contact with the flange 543 on the other side of the collector 54, thereby inhibiting leakage of the ink guided by the ink guide 52 to the outer circumference of the holder part 53. In this embodiment, while the small diameter cylindrical part 53*b* of the holder part 53 extends from the distal end of the cylindrical holding part 55, the distal end of the cylindrical holding part 55 and the distal end of the small diameter cylindrical part 53*b* of the holder part 53 are formed into a tapered cylinder together to constitute a substantially continuous tapered surface.

Further, the pen body 2 exposes the distal end of the cylindrical holding part 55, the distal end (the small diameter cylindrical part 53*b*) of the holder part 53, and the distal end of the pen tip 51 to the outside, while the refill 5 configured as above is fitted into the exterior body 4 (the barrel shaft 40). Thus, in this embodiment, the distal end of the cylindrical holding part 55 and the distal end (the small diameter cylindrical part 53*b*) of the holder part 53 of the pen body 2 (the refill 5) constitute a user's grip.

The pen 1 (the refill 5) according to this embodiment is configured as above. Next, the action thereof will be described.

In the pen 1 (the refill 5) configured as above, the ink in the ink reservoir 50 is guided by the ink guide 52. Then, the ink guided by the ink guide 52 is supplied, upon reaching the other end of the ink guide 52, from the other end of the ink guide 52 toward the pen tip 51 side. In this embodiment, the proximal end of the pen tip 51 has poor liquid permeability since it is formed as the welded portion 512 formed by fusion welding of the fine hair strands 510, and therefore the ink guide 52 supplies the ink to the outer circumference of the pen tip 51.

More specifically, the other end of the ink guide 52 is arranged to overlap the second openings 535 opening on the annular surface 531, and therefore the ink supplied from the other end of the ink guide 52 flows into the second openings 535.

In this embodiment, the second openings 535 are formed into a slit shape, and therefore the capillary force is generated in the second openings 535. This causes an action of drawing the ink in the second openings 535, and the ink from the ink guide 52 smoothly flows into the second openings 535.

Further, the ink holding parts 533 communicating with the second openings 535 are also formed into a slit shape, and therefore the capillary force is generated also in the ink holding parts 533. This causes an action of drawing the ink also in the ink holding parts 533, and the ink flowing in from the second openings 535 smoothly flows into the ink holding parts 533. Further, the first openings 534 communicating with the ink holding parts 533 are also formed into a slit shape, and therefore the capillary force is generated in the first openings 534. This causes an action of drawing the ink in the first openings 534, and the ink in the ink holding parts 533 smoothly flows into the first openings 534. As a result, the ink holding parts 533, the first openings 534, and the second openings 535 are filled with the ink.

Since the first openings 534 open on the inner circumferential surface 532 that defines the through hole 530 (the continuous hole 536) through which the pen tip 51 is inserted, the ink that has reached the first openings 534 is supplied to the pen tip 51. Thereby, the pen tip 51 is abundantly supplied with the ink, and the ink is rendered applicable to the ink coating target (makeup target).

When the distal end of the pen tip 51 contacts the ink coating target, the ink on the pen tip 51 is consumed. Then, owing to the chain of capillary force or surface tension of the pen tip 51, the first openings 534, the ink holding parts 533, the second openings 535, and the ink guide 52, the ink in the ink reservoir 50 is supplied to the pen tip 51 through the aforementioned route. Accordingly, the pen 1 according to this embodiment can continuously apply the ink to the ink coating target.

Meanwhile, when not in use, the ink is not supplied to the pen tip 51 from the ink reservoir 50, but the ink holding parts 533 hold the ink by its ink holding force (capillary force in this embodiment). Further, the first openings 534 communicate with the ink holding parts 533 and open on the inner circumferential surface 532 that defines the through hole 530 through which the pen tip 51 is inserted, and therefore the ink in the ink holding parts 533 is in contact with the pen tip 51 via the first openings 534.

This maintains the pen tip 51 in a moist state, thereby suppressing it from being in a dry state. Accordingly, the use of the pen 1 according to this embodiment can be smoothly started.

As described above, the pen 1 (the refill 5) according to this embodiment includes: the ink reservoir 50 configured to store the ink; the pen tip 51 having the proximal end and the distal end opposite to the proximal end, the pen tip 51 being configured to apply the ink to the ink coating target; the ink guide 52 configured to guide the ink in the ink reservoir 50 toward the pen tip 51; and the holder part 53 having the through hole 530 through which the pen tip 51 is inserted, the holder part 53 being configured to hold at least the proximal end of the pen tip 51 while exposing the distal end of the pen tip 51 in the state where the pen tip 51 is inserted through the through hole 530, wherein the holder part 53 includes the ink holding parts 533 capable of holding the ink from the ink guide 52 and formed at least partially around the circumference of the through hole 530, and the first openings 534 opening on the inner circumferential surface 532 that defines the through hole 530 and communicating with the ink holding parts 533.

According to the pen 1 (the refill 5) configured as above, the ink in the ink reservoir 50 is supplied to the pen tip 51 via the ink guide 52, and the pen tip 51 is abundantly supplied with the ink.

Therefore, when the distal end of the pen tip 51 exposed from the holder part 53 contacts the ink coating target, the ink adhering to the pen tip 51 is transferred to the coating target, and the ink on the pen tip 51 is consumed. Along with this, the ink stored in the ink reservoir 50 is supplied to the pen tip 51 via the ink guide 52.

Accordingly, the pen 1 (the refill 5) according to this embodiment can continuously apply the ink to the ink coating target.

As described above, when the ink in the ink reservoir 50 is supplied to the ink guide 52, the ink is directly or indirectly supplied to the ink holding parts 533 to be held by the ink holding parts 533. That is, the ink is held by the ink holding parts 533, thereby forming ink pools on the circumference of the pen tip 51.

In the pen 1 (the refill 5) according to this embodiment, the holder part 53 includes the first openings 534 opening on the inner circumferential surface 532 that defines the through hole 530 and communicating with the ink holding parts 533, and therefore the ink held in the ink holding parts 533 is in contact with the pen tip 51 inserted through the through hole 530, so that an effect of moisturizing the pen tip 51 is given. As a result, the dryness of the pen tip 51 is suppressed, and the use thereof can be smoothly started.

In the pen 1 (the refill 5) according to this embodiment, the ink holding parts 533 are formed into a slit shape, and therefore the ink holding parts 533 can exert capillary force and can reliably hold the inflowing ink. Further, in the pen 1 (the refill 5) according to this embodiment, the first openings 534 are formed into a slit shape, and therefore the first openings 534 can exert capillary force. Therefore, the first openings 534 can have ink drawing force or ink holding force.

Further, in the pen 1 (the refill 5) according to this embodiment, the plurality of ink holding parts 533 are formed around the circumference of the through hole 530, and the plurality of first openings 534 are formed around the circumference of the through hole 530, corresponding to the plurality of ink holding parts 533, and therefore liquid pools of the ink are formed at a plurality of points on the outer circumference of the pen tip 51, so that the effect of moisturizing the pen tip 51 can be further enhanced.

In particular, in the pen 1 (the refill 5) according to this embodiment, the holder part 53 further includes the distal end face from which the distal end of the pen tip 51 extends, the annular surface 531 formed around the circumference of the through hole 530 and facing opposite to the distal end face of the holder part 53, and the second openings 535 opening on the annular surface 531 and communicating with the ink holding parts 533. Therefore, the first openings 534 and the second openings 535 each communicate with the corresponding ink holding parts 533, so that the ink flows into the ink holding parts 533 from at least either of the first openings 534 and the second openings 535.

Then, since each ink holding part 533 is a space opening at two points of the corresponding first opening 534 and the corresponding second opening 535, when the ink flows through one of the first opening 534 and the second opening 535 toward the ink holding part 533, the air or ink in the ink holding part 533 is extruded through the other of the first opening 534 and the second opening 535 to the outside. Thus, the pen 1 (the refill 5) according to this embodiment allows the ink from the ink guide 52 to smoothly flow into the ink holding part 533, so that a necessary and sufficient amount of ink can be held in the ink holding part 533.

In particular, the second openings 535 are formed into a slit shape, and therefore the second openings 535 can exert capillary force. Therefore, the second openings 535 can have ink drawing force or ink holding force.

Further, since the ink guide 52 is formed into a rod shape having one end connected to the ink reservoir 50 and the other end opposite to the one end, and the other end is formed to overlap the second openings 535, the ink in the ink reservoir 50 is guided to the other end of the ink guide 52 overlapping the second openings 535 of the holder part 53. Accordingly, the ink flows into the ink holding parts 533 through the second openings 535, and the ink holding parts 533 hold the ink. That is, the ink holding parts 533 are filled with the ink. When the ink is supplied from the ink guide 52, the ink in the ink holding parts 533 is supplied to the pen tip 51 through the first openings 534 while maintaining the state where the ink holding parts 533 are filled with the ink. Then, when the ink is transferred to the ink coating target, and the ink on the pen tip 51 is consumed, the ink is supplied to the pen tip 51 via the aforementioned route. Further, in an unused state, the ink holding parts 533 maintain the state of holding the ink, and therefore the pen tip 51 is maintained in a moist state.

The present invention is not limited to the aforementioned embodiment, and modifications can be appropriately made without departing from the gist of the present invention.

In the aforementioned embodiment, the pen 1 as a makeup kit used for cosmetics has been described, but there is no limitation to such a configuration. For example, the pen 1 may be, of course, a writing instrument (stationery) for writing.

In the aforementioned embodiment, the pen 1 in which the ink reservoir 50 of the pen refill 5 is provided inside the exterior body 4 (the barrel shaft 40), and the pen refill 5 is fixedly secured to the exterior body 4 (the barrel shaft 40) has been described, but there is no limitation to such a configuration. For example, the pen 1 may be configured so that the pen refill 5 is detachably (replaceably) attached to the exterior body 4 (the barrel shaft 40). That is, the pen refill 5 is not limited to the configuration of being fixedly secured to the exterior body 4 (the barrel shaft 40) and may have a configuration of being detachably attached to the exterior body 4 (the barrel shaft 40).

Further, the pen 1 is not limited to the configuration in which the pen refill 5 is attached to the exterior body 4 (the barrel shaft 40) and may be configured, for example, so that the exterior body 4 (the barrel shaft 40) forms the ink reservoir 50, and the ink guide 52, the holder part 53, and the pen tip 51 are attached to the exterior body 4 (the barrel shaft 40). That is, the pen refill 5 may serve as the pen 1 itself by adjusting the outer diameter and the size of the pen refill 5 to those suitable for writing.

Figure 12:
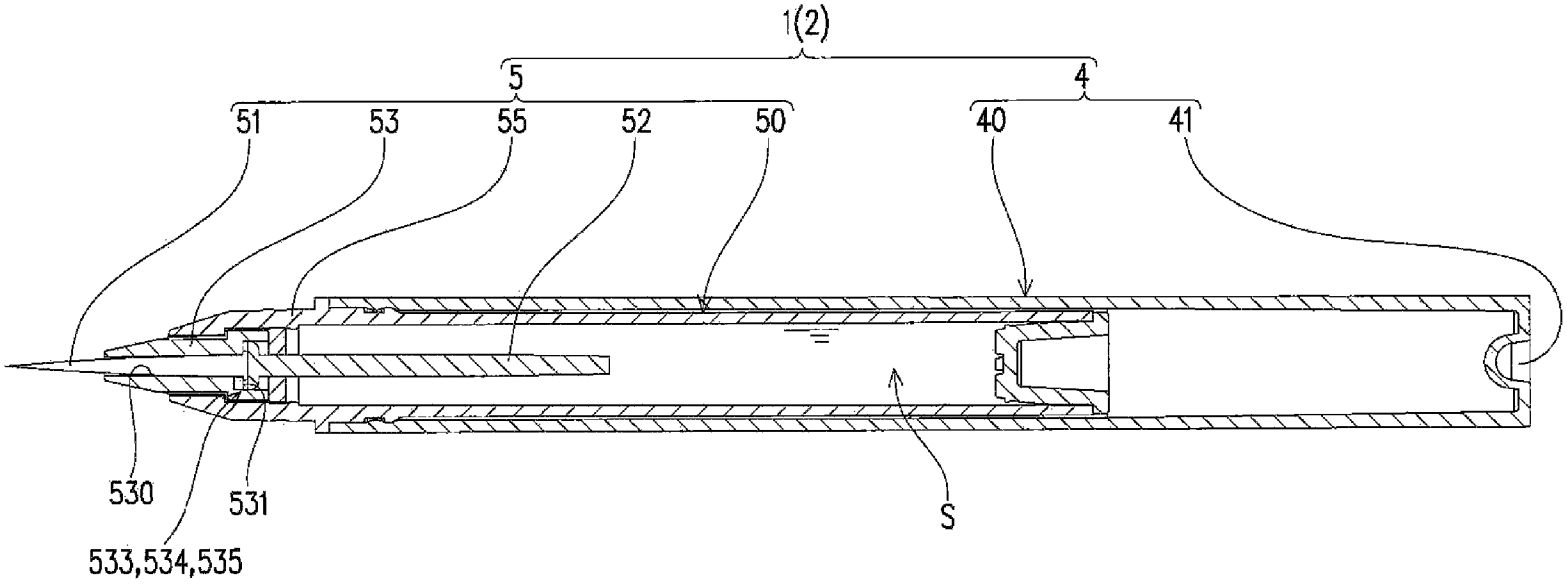
FIG. 12 is a sectional view of a pen (pen body) according to another embodiment of the present invention.

In the aforementioned embodiment, the liquid ink is contained in the ink reservoir 50 formed into a tank shape as it is, and the collector 54 configured to adjust the supply amount of the ink from the ink reservoir 50 to the pen tip 51 is provided, but there is no limitation to such a configuration. For example, as shown in FIG. 12, the ink in the ink reservoir 50 may be supplied to the pen tip 51 simply using the ink guide 52 without providing the collector 54.

Figure 13:
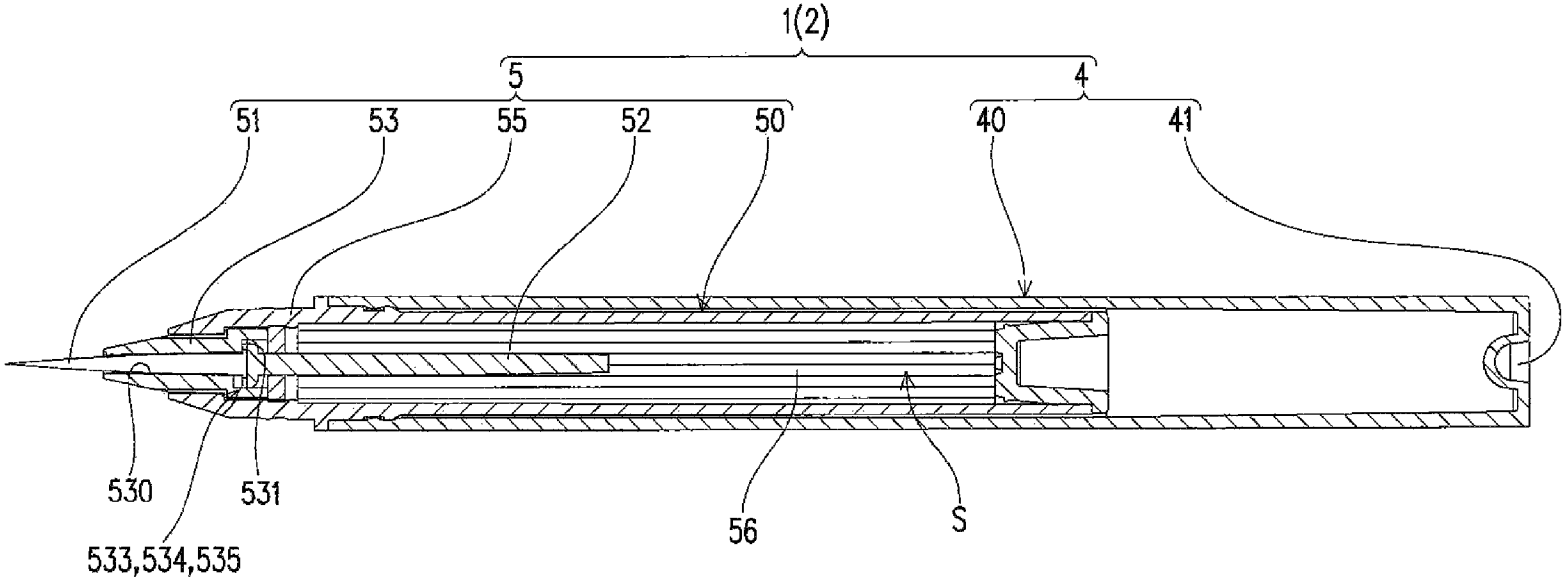
FIG. 13 is a sectional view of a pen (pen body) according to still another embodiment of the present invention.
Figure 14:
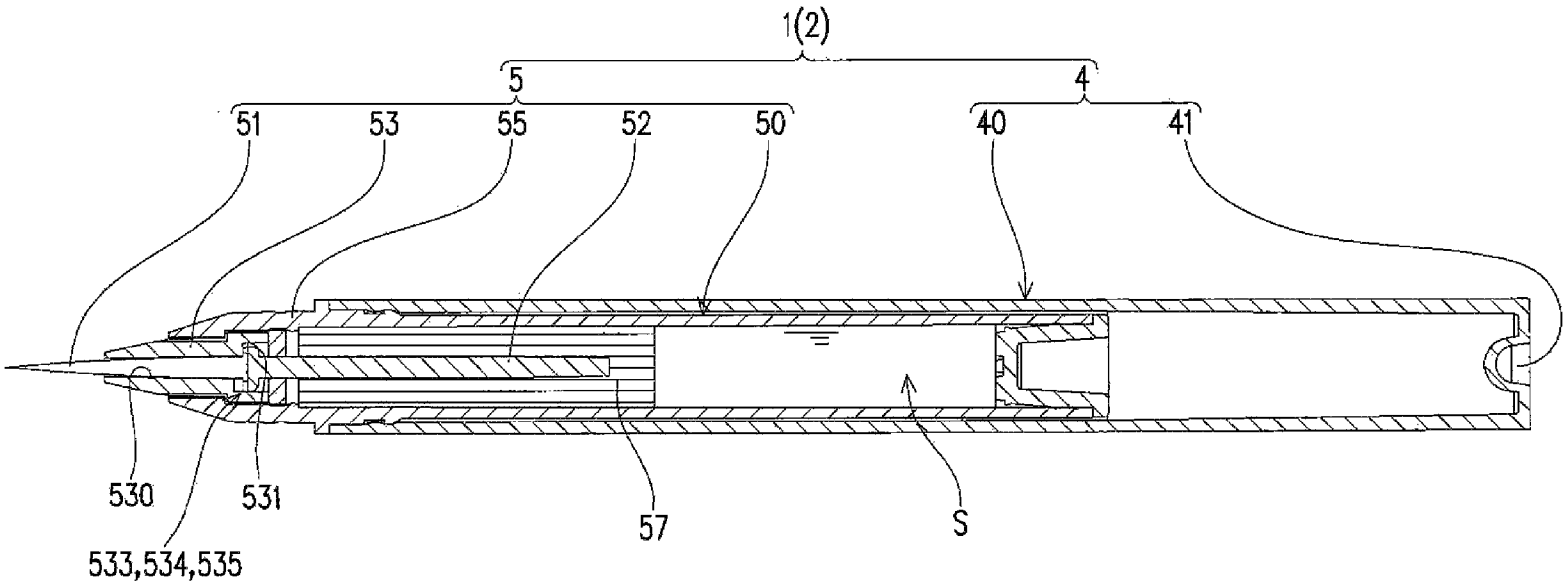
FIG. 14 is a sectional view a pen (pen body) according to still another embodiment of the present invention.

Further, the ink reservoir 50 may be constituted by an ink absorbing member 56 with which the entire internal space S is filled and which has absorbed an ink, as shown in FIG. 13, or may be constituted by a specific region of the internal space S filled with a liquid ink and an ink absorbing member 57 which has liquid absorbability with which the remaining region of the internal space S is filled, and which has absorbed the ink, as shown in FIG. 14.

In the aforementioned embodiment, the holder part 53 includes the second openings 535, but there is no limitation to such a configuration. For example, the configuration may be such that the holder part 53 includes only the ink holding parts 533 and the first openings 534, as members for allowing the ink to flow therein or holding the ink, and the ink flows into and out of the ink holding parts 533 through the first openings 534. In this case, if the ink holding parts 533 are formed as closed spaces, the air or the ink remaining in the ink holding parts 533 tends to inhibit the inflow and outflow of the ink through the first openings 534, and therefore it is preferable to provide air passages (air passages configured to communicate the ink holding parts 533 with the outside) for allowing the ink holding parts 533 to be open spaces.

In the aforementioned embodiment, the ink holding parts 533 are formed into a slit shape extending in the same direction as the axial center of the through hole 530, but there is no limitation to such a configuration. For example, the ink holding parts 533 may be formed into a slit shape extending in the circumferential direction of the through hole 530. In this case, the ink holding parts 533 may be formed into an annular groove shape that forms an endless circle around the circumference of the through hole 530 or may be formed into a groove shape partially on the inner circumferential surface 532 that defines the through hole 530. Further, the ink holding parts 533 are not limited to those formed into a slit shape (groove shape), and may be simple hollows. Further, the ink holding parts 533 are not limited to the plurality of ink holding parts 533 formed around the circumference of the through hole 530 or those formed around the entire circumference of the through hole 530. For example, only one ink holding part 533 needs to be provided at at least one point around the circumference of the through hole 530.

In the aforementioned embodiment, the first openings 534 are formed into a slit shape extending in the same direction as the axial center of the through hole 530, corresponding to the ink holding parts 533, but there is no limitation to such a configuration. For example, in the case where the ink holding parts 533 are formed into a slit shape extending in the circumferential direction of the through hole 530, the first openings 534 may be formed into a slit shape extending along the ink holding parts 533. In this case, the first openings 534 may be formed to open continuously over the entire perimeter of the inner circumferential surface 532 or may be formed to open partially on the inner circumferential surface 532. Further, the first openings 534 are not limited to those corresponding to the form of the ink holding parts 533, and may be in a different form from the ink holding parts 533. That is, the form of the first openings 534 can be variously changed as long as they open on the inner circumferential surface 532 that is opposed to the pen tip 51 and communicate with the ink holding parts 533.

In the aforementioned embodiment, the second openings 535 are formed into a slit shape on the annular surface 531 corresponding to the ink holding parts 533, but there is no limitation to such a configuration. That is, the form of the second openings 535 can be variously changed as long as they open on a surface (the annular surface 531) facing opposite to the distal end of the holder part 53 and communicate with the ink holding parts 533.

Figure 15:
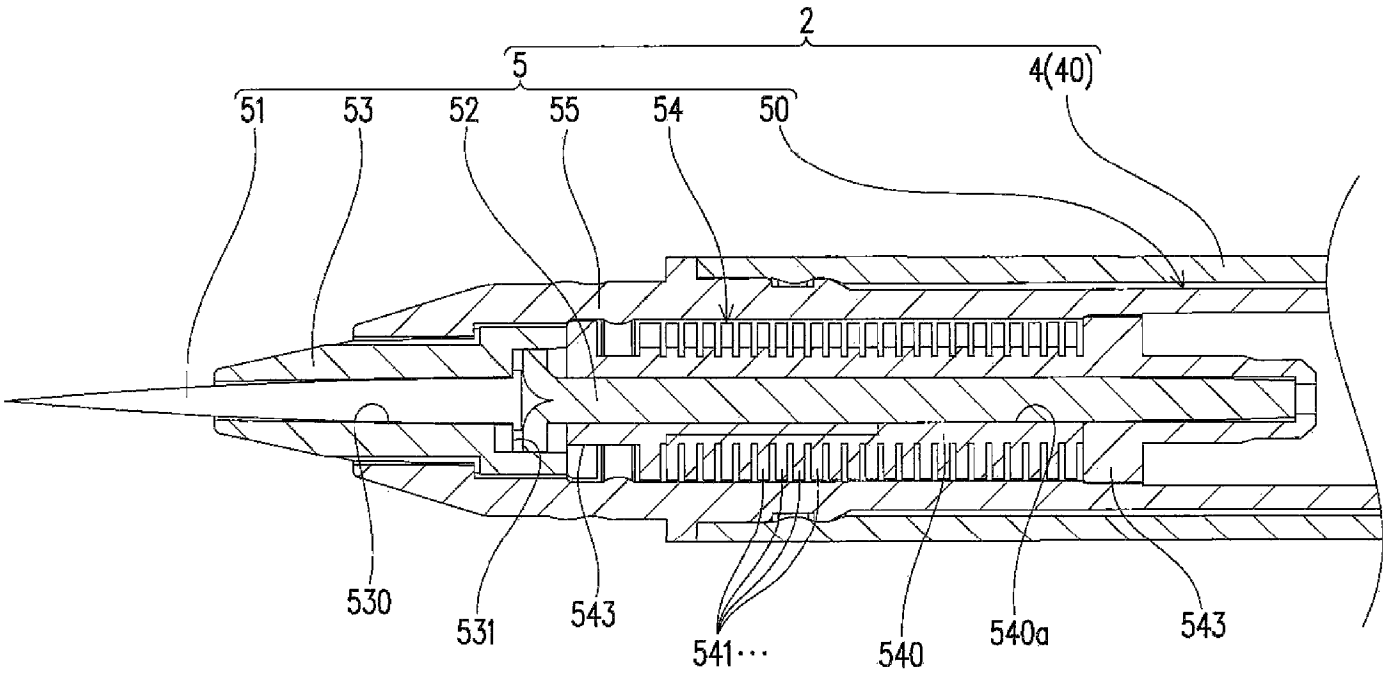
FIG. 15 is a partial sectional view of a pen (pen body) according to still another embodiment of the present invention.

In the aforementioned embodiment, the other end of the ink guide 52 (induction core) is molded to have a larger diameter in order to supply the ink to the second openings 535, but in the case where the ink is supplied to the second openings 535, the form of the ink guide 52 is not limited to the aforementioned form. For example, as shown in FIG. 15, the other end of the ink guide 52 may be formed to have at least two or more divided portions divided with respect to its axial center, so that the two or more divided portions extend in a direction intersecting the axial center and overlap the second openings 535. In this way, the ink can be supplied to the second openings 535 with a simple configuration. In the case where the ink guide 52 has two or more divided portions at the other end as described above, the two or more divided portions may be molded integrally with other parts of the ink guide 52. That is, the ink guide 52 may be configured so that the whole body is integrally molded using a mold having a shape corresponding to the final form including two or more divided portions. As another embodiment, the two or more divided portions may be formed by splitting an end of a rod-shaped material into two or more parts and bending the parts. That is, the ink guide 52 may be configured so that the two or more divided portions are formed by splitting an end of a rod-shaped material into two or more parts and bending the split parts.

In the aforementioned embodiment, the ink is supplied to the second openings 535, and the ink is supplied to the pen tip 51 via the ink holding parts 533 and the first openings 534, but there is no limitation to such a configuration. For example, the other end of the ink guide 52 that is formed into a rod shape may be inserted into the pen tip 51. In this way, the ink guide 52 directly supplies the ink to the pen tip 51. In this case, when the pen tip 51 is abundantly supplied with the ink, the ink in the pen tip 51 flows through the first openings 534 into the ink holding parts 533, and the ink holding parts 533 hold the inflowing ink. Accordingly, liquid pools of the ink are formed on the circumference of the pen tip 51, and thus the pen tip 51 is maintained in a moist state by the ink held in the ink holding parts 533 (the ink in contact via the first openings 534) even if an unused state continues. In this case, if the second openings 535 are provided in the same manner as in the aforementioned embodiment, the ink holding parts 533 are configured as open spaces, and therefore the air in the ink holding parts 533 can be pushed out through the second openings 535 when the ink flows in through the first openings 534, thereby making the inflow of the ink into the ink holding parts 533 smooth and reliable.

In the aforementioned embodiment, the first openings 534 and the second openings 535 continuously open at the connection point between the inner circumferential surface 532 of the through hole 530 (the continuous hole 536) and the annular surface 531, but there is no limitation to such a configuration. For example, in the case where the holder part 53 includes the first openings 534 and the second openings 535, the first openings 534 and the second openings 535 may be discontinuously formed as long as they communicate with the ink holding parts 533.

REFERENCE SIGNS LIST

1: Pen
2: Pen body
3: Cap
4: Exterior body
5: Pen refill
5: Pen refill (refill)
40: Barrel shaft
41: Tail
50: Ink reservoir
51: Pen tip
52: Ink guide
53: Holder part
53*a*: Large diameter cylindrical part
53*b*: Small diameter cylindrical part
54: Collector
55: Cylindrical holding part
500: Circumferential wall
501: Closure part
510: Fine hair strands
512: Welded portion
530: Through hole
530*a*: Inner hole
530*b*: Inner hole
530*c*: Large diameter hole
530*d*: Small diameter hole
531: Annular surface
532: Inner circumferential surface
532*b*: Inner circumferential surface
532*d*: Inner circumferential surface
533: Ink holding part
534: First opening
535: Second opening
536: Continuous hole
540: Main shaft
540*a*: Through hole
541: Partition blades
542, 543: Flange
544: Slit
545: Cutout
S: Internal space

The invention claimed is:

1. A pen comprising:
an ink reservoir configured to store an ink;
a pen tip having a proximal end and a distal end opposite to the proximal end, the pen tip being configured to apply an ink to an ink coating target;
an ink guide configured to guide the ink in the ink reservoir toward the pen tip; and
a holder part comprising a through hole through which the pen tip is inserted, the holder part being configured to hold at least the proximal end of the pen tip while exposing the distal end of the pen tip in the state where the pen tip is inserted through the through hole, wherein
the holder part comprises: an ink holding part capable of holding the ink from the ink guide and formed at least partially around a circumference of the through hole; and a first opening opening on an inner circumferential surface that defines the through hole and communicating with the ink holding part.

2. The pen according to claim 1, wherein the ink holding part is formed into a slit shape.

3. The pen according to claim 1, wherein the first opening is formed into a slit shape.

4. The pen according to claim 1, wherein
a plurality of ink holding parts as set forth are formed around the circumference of the through hole, and
a plurality of first openings as set forth are formed around the circumference of the through hole, corresponding to the plurality of ink holding parts.

5. The pen according to claim 1, wherein
the holder part further comprises: a distal end face from which the distal end of the pen tip extends; an annular surface formed around the circumference of the through hole and facing opposite to the distal end face; and a second opening opening on the annular surface and communicating with the ink holding part.

6. The pen according to claim 5, wherein the second opening is formed into a slit shape.

7. The pen according to claim 5, wherein
the ink guide is formed into a rod shape having one end connected to the ink reservoir and the other end opposite to the one end, and
the other end is formed to overlap the second opening.

8. The pen according to claim 7, wherein
the other end of the ink guide has at least two or more divided portions divided with respect to its axial center, and
the two or more divided portions are formed to extend in a direction intersecting its axial center and overlap the second opening.

9. A pen refill comprising:
an ink reservoir configured to store an ink and housed in a barrel shaft constituting the exterior of a pen;
a pen tip having a proximal end and a distal end opposite to the proximal end, the pen tip being configured to apply an ink to an ink coating target by being exposed from the barrel shaft;
an ink guide configured to guide the ink in the ink reservoir toward the pen tip; and
a holder part comprising a through hole through which the pen tip is inserted, the holder part being configured to hold at least the proximal end of the pen tip while exposing the distal end of the pen tip in the state where the pen tip is inserted through the through hole, wherein
the holder part comprises: an ink holding part capable of holding the ink from the ink guide and formed at least partially around a circumference of the through hole; and a first opening opening on an inner circumferential surface that defines the through hole and communicating with the ink holding part.

10. The pen refill according to claim 9, wherein the ink holding part is formed into a slit shape.

11. The pen refill according to claim 9, wherein the first opening is formed into a slit shape.

12. The pen refill according to claim 9, wherein
a plurality of ink holding parts as set forth are formed around the circumference of the through hole, and
a plurality of first openings as set forth are formed around the circumference of the through hole, corresponding to the plurality of ink holding parts.

13. The pen refill according to claim 9, wherein
the holder part further comprises: a distal end face from which the distal end of the pen tip extends; an annular surface formed around the circumference of the through hole and facing opposite to the distal end face; and a second opening opening on the annular surface and communicating with the ink holding part.

14. The pen refill according to claim 13, wherein the second opening is formed into a slit shape.

15. The pen refill according to claim 13, wherein the ink guide is formed into a rod shape having one end connected to the ink reservoir and the other end opposite to the one end, and the other end is formed to overlap the second opening.

16. The pen refill according to claim 15, wherein the other end of the ink guide has at least two or more divided portions divided with respect to its axial center, and the two or more divided portions are formed to extend in a direction intersecting its axial center and overlap the second opening.

* * * * *